US005292194A

United States Patent [19]

Gabor

[11] Patent Number: 5,292,194

[45] Date of Patent: Mar. 8, 1994

[54] DEVICE FOR PREPARING LIQUID TO THIN PULPY MEDIA

[76] Inventor: Dieter Gabor, Im Holzgarten 2/1, 7143, Vaihingen/Enz, Fed. Rep. of Germany

[21] Appl. No.: 656,095

[22] PCT Filed: Aug. 16, 1989

[86] PCT No.: PCT/DE89/00535

§ 371 Date: Feb. 14, 1991

§ 102(e) Date: Feb. 14, 1991

[87] PCT Pub. No.: WO90/01985

PCT Pub. Date: Mar. 8, 1990

[30] Foreign Application Priority Data

Aug. 16, 1988 [DE] Fed. Rep. of Germany ..... 3827659

[51] Int. Cl.[5] ..... B01F 5/12

[52] U.S. Cl. ..... 366/263; 366/164; 366/262; 415/58.4; 416/92

[58] Field of Search ..... 366/164, 168, 171, 182, 366/262-266, 270, 349; 261/87, 91; 416/20 R, 92; 415/52.1, 58.4; 137/896

[56] References Cited

U.S. PATENT DOCUMENTS

| | | | |
|---|---|---|---|
| 1,309,219 | 7/1919 | Ruth, Jr. | 366/263 X |
| 1,338,996 | 5/1920 | Norcross | 366/171 |
| 1,362,131 | 12/1920 | Norcross | 366/263 X |
| 1,417,883 | 5/1922 | Beers | 261/87 |
| 1,867,824 | 7/1932 | Hammerly | 261/91 X |
| 2,090,384 | 8/1937 | Durdin, 3rd | 261/91 X |
| 2,148,446 | 2/1939 | Drake | 261/91 X |
| 2,165,889 | 7/1939 | Fischer et al. | 261/91 X |
| 2,186,371 | 1/1940 | Durdin, Jr. | 261/91 X |
| 2,346,366 | 4/1944 | Durdin, 3rd | 261/91 X |
| 2,530,814 | 11/1950 | Becze et al. | 366/263 X |
| 3,961,775 | 6/1976 | Markus | 366/265 |
| 4,021,349 | 5/1977 | Kaelin | 261/91 X |
| 4,189,262 | 2/1980 | Anderson | 406/136 |
| 4,628,391 | 12/1986 | Nyman | 366/265 |
| 4,848,918 | 7/1989 | Kingsley et al. | 366/262 |
| 4,938,606 | 7/1990 | Kunz | 366/164 X |

FOREIGN PATENT DOCUMENTS

| | | | |
|---|---|---|---|
| 73729 | 3/1983 | European Pat. Off. . | |
| 687839 | 2/1940 | Fed. Rep. of Germany . | |
| 1066403 | 10/1959 | Fed. Rep. of Germany . | |
| 1143490 | 2/1963 | Fed. Rep. of Germany . | |
| 1193433 | 5/1965 | Fed. Rep. of Germany | 366/168 |
| 1557054 | 8/1969 | Fed. Rep. of Germany . | |
| 3241011 | 5/1984 | Fed. Rep. of Germany . | |
| 3325952 | 1/1985 | Fed. Rep. of Germany . | |
| 3633499 | 5/1988 | Fed. Rep. of Germany . | |
| 1283257 | 12/1961 | France | 210/194 |
| 1416113 | 9/1965 | France | 137/896 |
| 1530719 | 7/1968 | France | 366/265 |
| 2218134 | 9/1974 | France | 261/87 |
| 404911 | 7/1966 | Switzerland . | |
| 1450848 | 1/1989 | U.S.S.R. | 366/263 |
| 1514625 | 10/1989 | U.S.S.R. | 366/265 |
| 15583 | of 1910 | United Kingdom . | |
| 1209422 | 10/1970 | United Kingdom . | |

*Primary Examiner*—James E. Bryant, III
*Assistant Examiner*—Charles Cooley
*Attorney, Agent, or Firm*—McGlew & Tuttle

[57] ABSTRACT

A device for preparing liquid to thin pulpy media having an inner chamber 1 is substantially symmetrical about longitudinal axis, and the inner chamber has a neck end and a passage end. An outer circumference of the inner chamber tapers down from the passage and to the neck end. An outer chamber surrounds the inner chamber, and the outer chamber is also substantially symmetrical about the longitudinal axis. The outer chamber communicates with the inner chamber through an opening in the neck of the inner chamber, and an opening in the passage end of the inner chamber. A centrifuge wheel is positioned inside the outer chamber and outside the inner chamber. The centrifuge wheel has an intake pipe extending from a center of the centrifuge wheel, and this intake pipe extends into the neck opening of the inner chamber. The centrifuge wheel and the intake pipe are substantially symmetrical with, and rotate about the longitudinal axis.

13 Claims, 3 Drawing Sheets

DEVICE FOR PREPARING LIQUID TO THIN PULPY MEDIA

FIELD OF THE INVENTION

The present invention relates in general to a device for circulating fluid and in particular to a device for preparing a range of fluids from a liquid to thin pulpy media.

BACKGROUND OF THE INVENTION

A great number of processes and devices for preparing liquid to thin pulpy media, have become known. These processes and devices are used mainly in the areas of wastewater treatment, water preparation, and the preparation of colloidal mixtures. To produce colloidal mixtures by turbulence, especially by means of rotors, intensive mixing of the starting components is achieved. The medium processed develops a colloidal structure due to the size reduction of macroscopic granules or by binding together a plurality of molecules to form clusters. In a prior-art device of this type (West German Offenlegungsschrift No. DE-OS 32,41,011), the medium to be treated is filled from the top into a funnel-shaped container. The medium flows through the funnel from top to bottom under the effect of the force of gravity. The medium leaves the funnel through an outlet opening provided at the lower end of the funnel. This device generates a vortex-like turbulence, which is intended to bring about intense mixing of the components present in the medium, e.g., cement and water. A further improved variant of this device has also become known (West German Offenlegungsschrift No. DE-OS 33,25,952), in which a two-chamber system is used. The inner, funnel-shaped chamber again serves to turbulize the medium flowing through from top to bottom under the effect of the force of gravity, while the outer chamber serves to return the medium leaving the inner chamber to the inlet opening of the inner chamber. A rotor mounted in the vertical axis of the container is used to return the medium. The vanes of the rotor are located in the outer chamber under the outlet opening of the inner chamber, and the rotor returns the medium to the inlet opening of the inner chamber against the force of gravity.

These prior-art devices have mainly the disadvantage that the efficiency is not high enough to achieve sufficient colloidization of the treated medium within a reasonable time. Despite the fact that propellers are provided to support the turbulizing effect of the force of gravity by suction and pumping, the amount of energy introduced is too small. Another disadvantage is the fact that the medium is returned to the inlet opening of the inner chamber against the force of gravity and this is also brought about by a propeller, which is arranged on the same axis as the propeller for generating the suction effect, which is arranged in the inner chamber. The flow conditions are thus undefined, and the amounts of energy introduced partially offset each other.

SUMMARY AND OBJECTS OF THE PRESENT INVENTION

The device according to the present invention has an inner chamber and an outer chamber. The inner chamber is substantially bottle-shaped with the cross-sectional area initially increasing then decreasing from one end to another. The outer chamber surrounds the inner chamber and it is preferable for the outer chamber to have a convex shape when viewed from the outside. The inner chamber communicates with the outer chamber by a neck opening at a neck end and passage openings at a passage end. A centrifuge wheel is positioned inside the outer chamber and outside the inner chamber. This centrifuge wheel has an intake pipe extending from the center of the centrifuge wheel through the neck opening of the inner chamber and into the inner chamber. The intake pipe has an opening inside the inner chamber. Fluid inside the inner chamber is drawn into the centrifuge wheel through the intake pipe. The fluid is then discharged from the circumferential edge of the centrifuge wheel and into the outer chamber. The fluid in the outer chamber then travels along the outside of the inner chamber and towards the passage openings between the outer chamber and the inner chamber. At the passage openings the fluid flows from the outer chamber into the inner chamber and thus completes the cycle.

The present invention has the advantages that it is possible to introduce a large amount of energy, exert a strong suction effect on the medium, and utilize the force of gravity to transport the medium from the outlet opening of the inner chamber through the outer chamber to the inlet opening of the inner chamber.

Thus, using the device according to the present invention, a colloidal mixture of very high value, e.g., a cement-water mixture of very high value, is obtained in a short time. However, the device according to the present invention can also be used to treat wastewater, in which case organic components of the wastewater are broken down, and thus are in addition partially dissolved or precipitated. The structure of the water may also change, e.g., due to cluster formation, which leads to a change in the properties of the water, e.g., in terms of its solubilizing properties or the ability to be absorbed by plants.

Advantageous embodiments and improvements of the device according to the present invention are described in the subclaims. In particular, provisions are made to make it possible to operate the device in continuous operation or in intermittent operation by providing shutoff devices for the inlet and outlet openings of the containers. In continuous operation, medium is fed in and treated medium is removed continuously, and the medium to be treated passes through both chambers and the centrifuge wheel arranged between the two chambers at least once. In intermittent operation, the inlet and outlet openings are closed after the container has been filled with the medium to be treated, and the device is operated until the medium reaches the desired consistency due to flowing several times through the two chambers and the centrifuge wheel.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
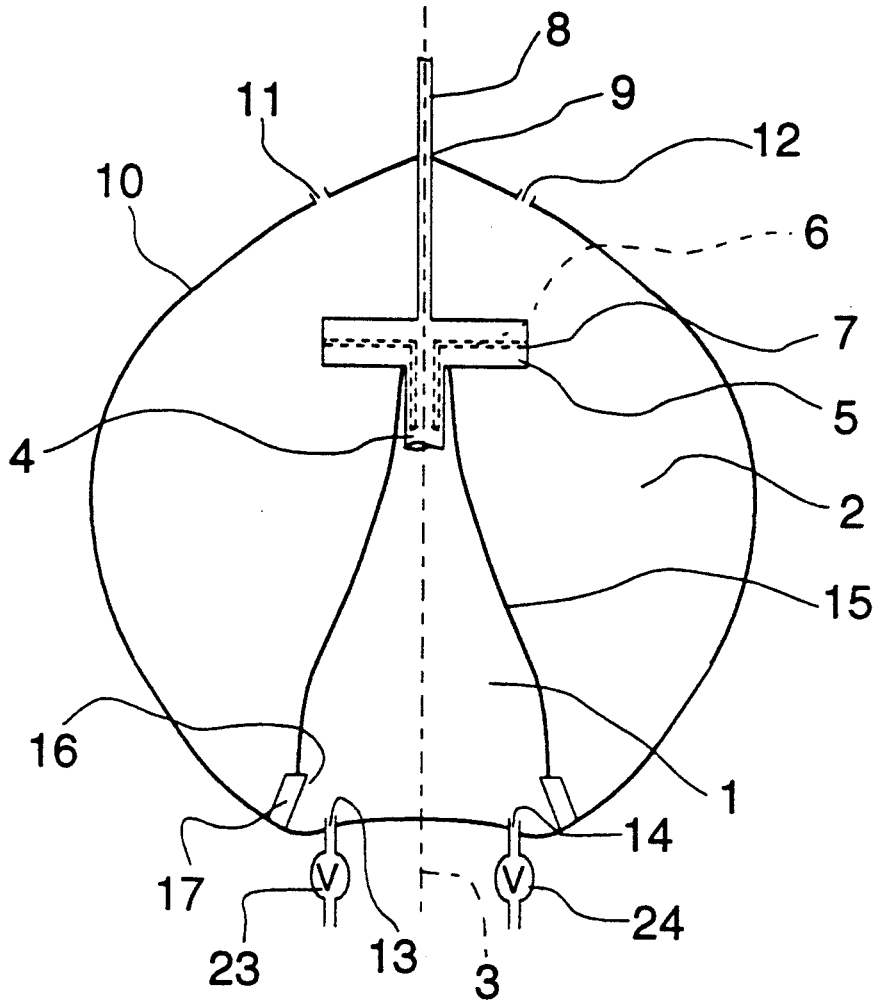
FIG. 1 shows a device according to the present invention with a bottle-shaped internal chamber and an outer chamber that is convex from the outside.
Figure 2:
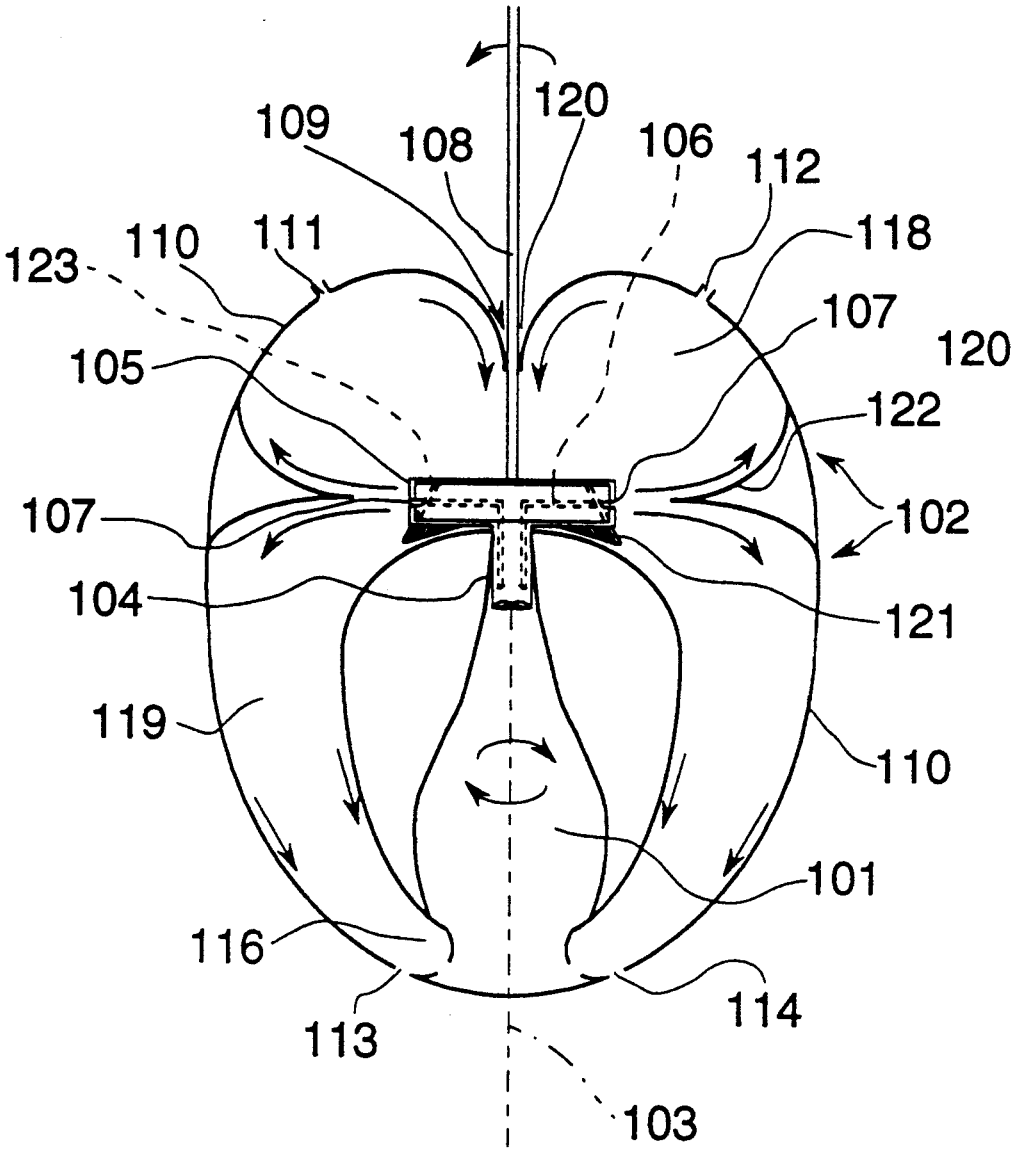
FIG. 2 shows a device according to the present invention with a bottle-shaped inner chamber and a two-part, heart-shaped outer chamber.

The device shown in FIG. 1 has a container with an upwardly tapering, bottle-shaped internal chamber 1 and a bell-shaped outer chamber 2 arranged around it. The two chambers are arranged rotationally symmetrically around an axis of symmetry 3. An intake pipe 4 dips into the upper area of the inner chamber 1, which forms so to speak the neck of the bottle. Another end of the intake pipe projects from the bottle neck of the inner chamber 1, and is connected to a centrifuge wheel 5 in a positive-locking manner. The centrifuge wheel 5 is also arranged rotationally symmetrically to the axis of symmetry 3 of the two chambers 1 and 2, and is provided with radial or flow channels 6, which extend from the area around the axis of rotation to the outer delimitation of the centrifuge wheel 5 and open into outlet openings 7 there. At the other end, another section the radial channels 6 open into the intake pipe 4. These other sections extend substantially parallel to the symmetrical or longitudinal axis in the intake pipe 4, as shown in FIGS. 1 and 2. To achieve this, these other sections are bent in the direction of the axis of symmetry 3. A drive shaft 8, which is connected to a drive unit (not shown), is hinged to the centrifuge wheel on a flat side facing away from the inner chamber 1. The drive shaft 8 is led into the outer space through an opening 9 in the outer wall 10 of the outer chamber 2. A packing is provided between the shaft 8 and the outer wall 10. The outer wall 10 is also provided in an upper area, with a high-pressure relief valve 11 and with a vacuum valve 12 to regulate the pressure in the outer chamber 2. The outer wall 10 has two more openings, in a lower area, namely, one inlet opening 13 and one outlet opening 14. The bottle-shaped outer wall 15 of the inner chamber 1 is rigidly connected to the outer wall 10 of the outer chamber 2. In front of baffles 17 a plurality of passage openings 16, are provided between the inner chamber 1 and the outer chamber 2.

The device according to the present invention shown in FIG. 2 has, a bottle-shaped inner chamber 101, a two-part outer chamber 102, with an upper or first chamber 118 and a lower or second chamber 119, which are connected to each other via a substantially circular crown opening 120. The outer wall 110 of the upper chamber 118 is again provided in its upper zone with a high-pressure relief valve 111 and a vacuum valve 112. The area of the lower chamber 119 has an inlet opening 113 and an outlet opening 114. The inner chamber 101 communicates with the lower chamber 119 via passage openings 116. An intake pipe 104 dips into the upper zone of the inner chamber 101, and another end of the intake pipe, which projects from the neck of the bottle, is connected to a centrifuge wheel 105, in a positive-locking manner. The centrifuge wheel 105 is arranged rotationally symmetrically around an axis of symmetry 103, which is also the axis of symmetry of the inner chamber 101 and the two-part outer chamber 102. The centrifuge wheel 105 has radial channels 106, which extend from the area around the axis of symmetry 103 radially to the outside of the centrifuge wheel and open into outlet openings 107 there. At the other end, the radial channels 106 open into the intake pipe 104. To achieve this, the radial channels 106 are bent in the direction of the axis of symmetry 103. A drive shaft 108, which is led through an opening 109 in the outer wall 110 of the two-part outer chamber 102, is hinged to the flat side of the centrifuge wheel 105 facing away from the inner chamber 101. A sealing member is provided between the drive shaft 108 and the outer wall 110. The centrifuge wheel 105 is provided on its flat side facing the inner chamber 101, with vanes 121, by which the medium located in the lower chamber 119 can be set into rotation. At the level of the outlet openings 107, the outer wall 110 of the outer chamber 102 is constricted, and a guide crown 122 is formed, which distributes the medium ejected from the radial channels 106 among the upper chamber 118 and the lower chamber 119. In addition, crown channels 123 extending obliquely from the inner top area to the outer bottom area, through which medium is able to flow from the upper chamber 118 into the lower chamber 119, are provided in the centrifuge wheel 105.

Figure 3:
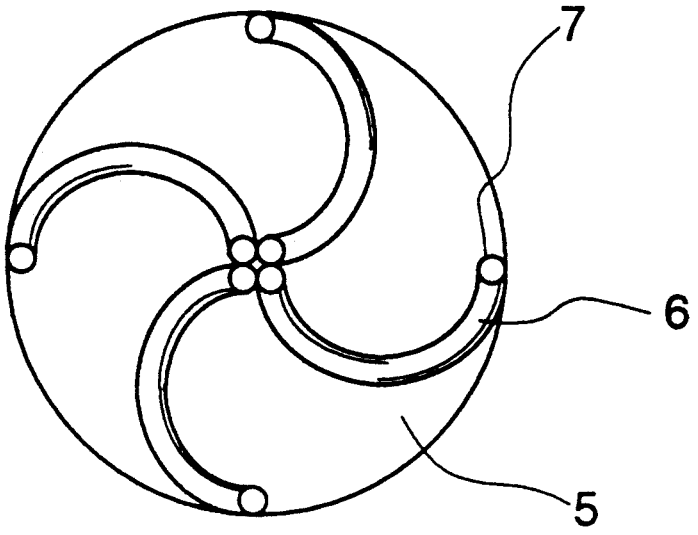
FIG. 3 shows a section through a centrifuge wheel according to the present invention with helical radial channels.

FIG. 3 shows a section through a centrifuge wheel 5 according to the present invention, in which the radial channels 6 extend in an arc-shaped pattern from the inside to the outside, and the outlet openings 7 are arranged approximately tangentially to the outer delimitation of the centrifuge wheel 5.

Figure 4:
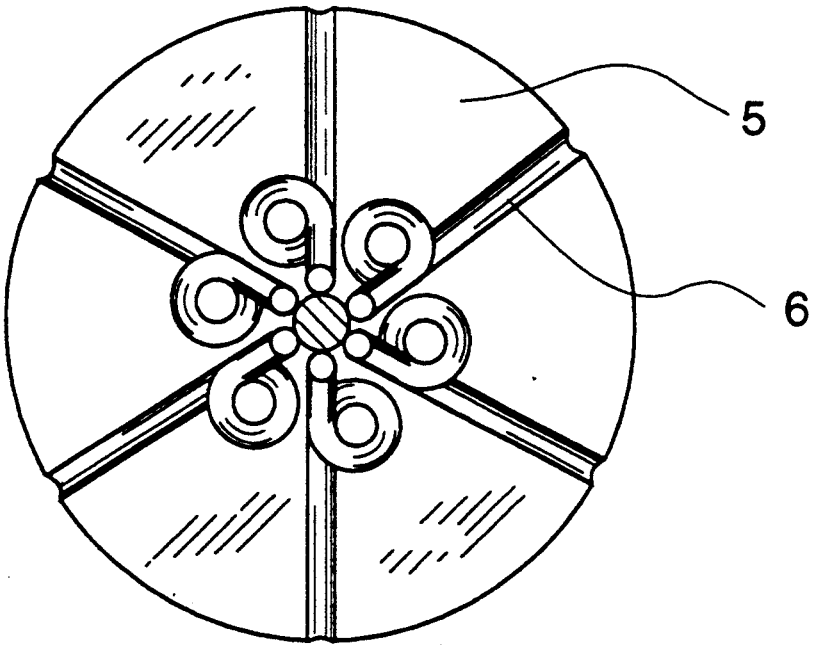
FIG. 4 shows a sectional view of another design of a centrifuge wheel according to the present invention.

FIG. 4 shows another variant of the course of the radial channels 6 inside the centrifuge wheel 5, in which the radial channels 6 are wound in themselves in a loop-shaped pattern. The beginning and the end of the loop are, of course, located at different horizontal levels of the centrifuge wheel 5, i.e., the radial channels 6 are not shown here as a sectional view.

The device described on the basis of FIGS. 1 through 4 operates as follows:

In intermittent operation, shut off outlet opening 14 is closed, the device is filled with the medium to be treated via the inlet opening 13 to a level just barely below the centrifuge wheel 5. The inlet opening 13 is then closed by shut off device 23, and the centrifuge wheel 5 is set into rapid rotation by a drive unit (not shown) via the drive shaft 8. The medium is drawn out of the inner chamber 1 by the vacuum built up in the radial channels 6 via the intake pipe 4 and ejected by centrifugal force into the outer chamber 2 from the outlet openings 7 of the radial channels 6. From the outer chamber 2, the medium returns into the inner chamber 1 through the passage openings 16. This process is maintained until the medium reaches the desired consistency. The process is carried out analogously with the device according to FIG. 2, and the medium ejected from the outlet openings 107 of the radial channels 106 is distributed by the guide crown 122 between the two chambers 118 and 119 here. The medium returns from the outer chamber 102 into the inner chamber 101 via passage openings 116 in this case as well, and it is drawn in from there via the intake pipe 104. After the desired consistency of the medium has been reached, the medium can be removed from the device through the respective outlet opening 14 or 114. It is also possible to bring about continuous passage of the medium through the device. To achieve this, the inlet opening 13 is arranged such that the medium to be treated is introduced directly into the inner chamber 1 and it can enter the outer chamber 2 only after passing through the centrifuge wheel, and it is removed continuously from the device via the outlet opening 14.

All the characteristics represented in the description, the claims below, and the drawing can be essential for the present invention both individually and in any combination with each other.

| List of Reference Numerals | |
|---|---|
| 1, 101 | inner chamber |
| 2, 102 | outer chamber |
| 3, 103 | axis of symmetry |
| 4, 104 | intake pipe |
| 5, 105 | centrifuge wheel |
| 6, 106 | channel |
| 7, 107 | outlet opening |
| 8, 108 | drive shaft |
| 9, 109 | opening |
| 10, 110 | outer wall of 2, 102 |
| 11, 111 | high-pressure relief valve |
| 12, 112 | vacuum valve |
| 13, 113 | inlet opening |
| 14, 114 | outlet opening |
| 15 | outer wall of 1 |
| 16, 116 | passage opening |
| 17 | baffle |
| 118 | upper chamber |
| 119 | lower chamber |
| 120 | opening |
| 121 | vane |
| 122 | guide crown |
| 123 | channel |

I claim:

1. A device for circulating fluid, the device comprising:

an inner chamber having a neck end and a passage end, said inner chamber being substantially symmetrical about a longitudinal axis, said inner chamber having an outer circumference, said outer circumference initially decreasing gradually in size and then decreasing more strongly from said passage end to said neck end to form a bottle like shape;

an outer chamber surrounding said inner chamber, said outer chamber being also substantially symmetrical about said longitudinal axis, said outer chamber communicating with said inner chamber through a neck opening in said neck end of said inner chamber and a passage opening in said passage end of said inner chamber;

a centrifuge wheel positioned inside said outer chamber and outside said inner chamber, said centrifuge wheel having an intake pipe extending from a center of said centrifuge wheel through said neck opening and into said inner chamber, said centrifuge wheel defining a plurality of separate radial channels extending from an outer delimitation of said centrifuge wheel to said longitudinal axis, each of said plurality of radial channels being bent into the direction of said longitudinal wax is as said each separate radial channel approaches said longitudinal axis, said intake pipe having an opening inside said inner chamber,. said centrifuge wheel and said intake pipe being substantially symmetrical with, and rotating about, said longitudinal axis.

2. Device in accordance with claim 1, further comprising a high-pressure relief valve means and a vacuum valve means for pressure regulation in said outer chamber.

3. A device in accordance with claim 1, wherein:

said intake pipe is firmly attached to said centrifuge wheel and said intake pipe rotates with said centrifuge wheel.

4. A device in accordance with claim 1, wherein:

said outer chamber has first and second ends substantially axially opposite each other along said longitudinal axis, said outer chamber has a cross-sectional area substantially perpendicular to said longitudinal axis, said cross-sectional area of said outer chamber having a maximum area in a substantially middle section of said outer chamber, said cross-sectional area of said outer chamber decreasing from said substantially middle section to said first and second ends.

5. A device in accordance with claim 1, wherein:

one of said inner chamber and said outer chamber defines an outlet opening and an inlet opening.

6. Device in accordance with claim 5, wherein: said inlet and outlet openings are equipped with shut-off devices.

7. A device in accordance with claim 1, wherein:

said plurality of radial channels having an arc-shape and opening substantially tangentially to said outer delimination of said centrifuge wheel.

8. A device in accordance with claim 1, wherein:

each of said separate radial channels are wound in a loop-shape pattern for deflecting the fluid.

9. A device in accordance with claim 1, further comprising:

guide crown means for dividing said outer chamber into a first chamber and a second chamber, said guide crown means defining a crown opening providing communication between said first and second chambers.

10. A device in accordance with claim 9, wherein:

said centrifuge wheel is positioned in said crown opening; and said guide crown means distributes fluid discharged by said centrifuge wheel into said first and second chambers, a direction of the fluid discharged into said first chamber being substantially opposite a direction of fluid discharged into said second chamber.

11. A device in accordance with claim 9, wherein:

said centrifuge wheel has crown channel means for passing the fluid from said first chamber to said second chamber.

12. A device in accordance with claim 9, wherein:

said centrifuge wheel has vane means for circulating the fluid in said second chamber around said longitudinal axis, said vane means being on a side of said centrifuge wheel disposed inside said second chamber.

13. A device for circulating fluid, the device comprising:

an inner chamber having a neck end and a passage end, said inner chamber being substantially symmetrical about a longitudinal axis, said inner chamber having an outer circumference initially tapering gradually and then more strongly down from said passage end to said neck end to form a bottle-like shape;

an outer chamber surrounding said inner chamber, said outer chamber being also substantially symmetrical about said longitudinal axis, said outer chamber communicating with said inner chamber through a neck opening in said neck end of said inner chamber and a passage opening of said inner chamber;

a centrifuge wheel positioned in side said outer chamber and outside said inner chamber, said centrifuge wheel having an intake pipe extending from a center of said centrifuge wheel through said neck opening and into said inner chamber, said centrifuge wheel defines a plurality of separate radial channels extending from an outer delimitation of said centrifuge wheel to said longitudinal axis, each of said plurality of said radial channels being bent into a direction of said longitudinal axis as said each separate radial channel approaches said longitudinal axis and extends into said intake pipe, said intake pipe having an opening inside said inner chamber, said centrifuge wheel and said intake pipe being substantially symmetrical with, and rotating about, said longitudinal axis.

* * * * *